United States Patent [19]

Wittmann et al.

[11] Patent Number: 4,967,689

[45] Date of Patent: Nov. 6, 1990

[54] APPARATUS AND METHOD FOR EVENLY COATING BUILDING TILE WITH MORTAR

[76] Inventors: Thomas P. Wittmann, 12000 Chaltenham, Des Peres, Mo. 63131; Donald R. Fuller, 10407 Janson, St. Louis, Mo. 63136

[21] Appl. No.: 302,545

[22] Filed: Jan. 26, 1989

[51] Int. Cl.[5] ..... B05C 3/18

[52] U.S. Cl. ..... 118/413; 118/428

[58] Field of Search ..... 118/407, 413, 428; 427/397.7, 356

[56] References Cited

U.S. PATENT DOCUMENTS

| | | | |
|---|---|---|---|
| D. 216,668 | 3/1970 | Tims et al. | D8/45 |
| 867,852 | 10/1907 | Switzer et al. . | |
| 1,068,155 | 7/1913 | Mosher . | |
| 2,329,378 | 9/1943 | Kuehner | 118/413 |
| 2,588,595 | 3/1952 | Warner | 118/413 X |
| 3,208,362 | 9/1965 | Sigmund | 94/46 |
| 4,115,976 | 9/1978 | Rohrer | 52/741 |
| 4,229,118 | 10/1980 | Kisling | 404/72 |
| 4,256,416 | 3/1981 | Bishop | 404/119 |
| 4,437,828 | 3/1984 | Egger | 425/458 |

*Primary Examiner*—Shrive Beck
*Assistant Examiner*—Alain Bashore
*Attorney, Agent, or Firm*—Senniger, Powers, Leavitt & Roedel

[57] ABSTRACT

An apparatus for evenly coating back surfaces of building tiles and the like with mortar. It comprises a doctor blade, rails which support and guide tiles for movement below the doctor blade with said back surfaces of the tiles facing generally upwardly. The apparatus is adapted for receiving and retaining a supply of mortar on said back surfaces of the tiles adjacent one side of the blade. The blade is positioned a preselected distance above said back surfaces of the tiles whereby as the tiles are urged under the blade said back surfaces thereof are completely coated with mortar and excess mortar is scraped from the tiles with the mortar remaining on said back surfaces being of a substantially uniform thickness. In the method of coating back surfaces of tiles with mortar, tiles are placed on the rails with the back surfaces facing generally upwardly. A supply of mortar is placed on at least one of the back surfaces adjacent the blade. The tiles are then urged under the blade with the back surfaces spaced a generally uniform distance below the blade whereby as the tiles are urged under the blade the back surfaces thereof are completely coated with mortar and excess mortar is scraped from the tiles with the mortar remaining on the back surfaces being of a substantially uniform thickness.

3 Claims, 2 Drawing Sheets

APPARATUS AND METHOD FOR EVENLY COATING BUILDING TILE WITH MORTAR

BACKGROUND OF THE INVENTION

This invention relates generally to building tile emplacement, and in particular to apparatus and a method for evenly coating building tiles and the like with mortar.

Building tile, such as ceramic tile, is commonly used as floor and wall coverings in buildings. Such tile is generally affixed to a floor or wall by mortar. Typically, mortar is spread over the floor, for example, by a trowel and the tile is then placed on the mortar. A problem associated with spreading the mortar only on the floor is that the tile might not be completely coated with mortar. If the tile is not completely coated then moisture may seep into gaps between the tile and floor to reduce the adhesion of the tile to the floor. To reduce the gaps it has been known to trowel mortar on the back surface of the tile before placing the tile on the mortar coated floor. The mortar must be evenly spread on all of the tiles so that the final tiled surface will be smooth. However, evenly coating the tiles with a trowel is rather difficult and time consuming.

SUMMARY OF THE INVENTION

Among the objects of the present invention may be noted the provision of an apparatus for completely and evenly coating back surfaces of building tiles and the like with mortar; the provision of such an apparatus which quickly coats building tiles; the provision of such an apparatus which is easy to operate; the provision of such an apparatus which is capable of accommodating tiles of different widths and thicknesses; the provision of such an apparatus which is compact and lightweight for ease of transportation; and the provision of such an apparatus which has a minimum of parts and which is of relatively simple and inexpensive construction.

Generally, the apparatus of the present invention is adapted for evenly coating back surfaces of building tiles and the like with mortar. It comprises a doctor blade, means for supporting and guiding tiles for movement below the doctor blade with said back surfaces of the tiles facing generally upwardly, and means for receiving and retaining a supply of mortar on said back surfaces of the tiles adjacent one side of the blade. The blade is positioned a preselected distance above said back surfaces of the tiles whereby as the tiles are urged under the blade said back surfaces thereof are completely coated with mortar and excess mortar is scraped from the tiles with the mortar remaining on said back surfaces being of a substantially uniform thickness.

In general, according to the method of the present invention, back surfaces of building tiles and the like are evenly coated with mortar. The method comprises providing an apparatus having a doctor blade adapted for scraping excess mortar from the back surfaces, means for supporting and guiding tiles for movement below the doctor blade, and means for receiving and retaining a supply of mortar on the back surfaces of the tiles adjacent one side of the blade. Tiles are placed on the guiding means with the back surfaces facing generally upwardly. A supply of mortar is placed on at least one of the back surfaces adjacent the blade. The tiles are then urged under the blade with the back surfaces spaced a generally uniform distance below the blade whereby as the tiles are urged under the blade the back surfaces thereof are completely coated with mortar and excess mortar is scraped from the tiles with the mortar remaining on the back surfaces being of a substantially uniform thickness.

These and other advantages will be in part apparent and in part pointed out hereinafter.

BRIEF DESCRIPTION OF THE DRAWINGS

Corresponding reference numerals indicate corresponding parts throughout the several views of the drawings.

DETAILED DESCRIPTION OF A PREFERRED EMBODIMENT

Figure 1:
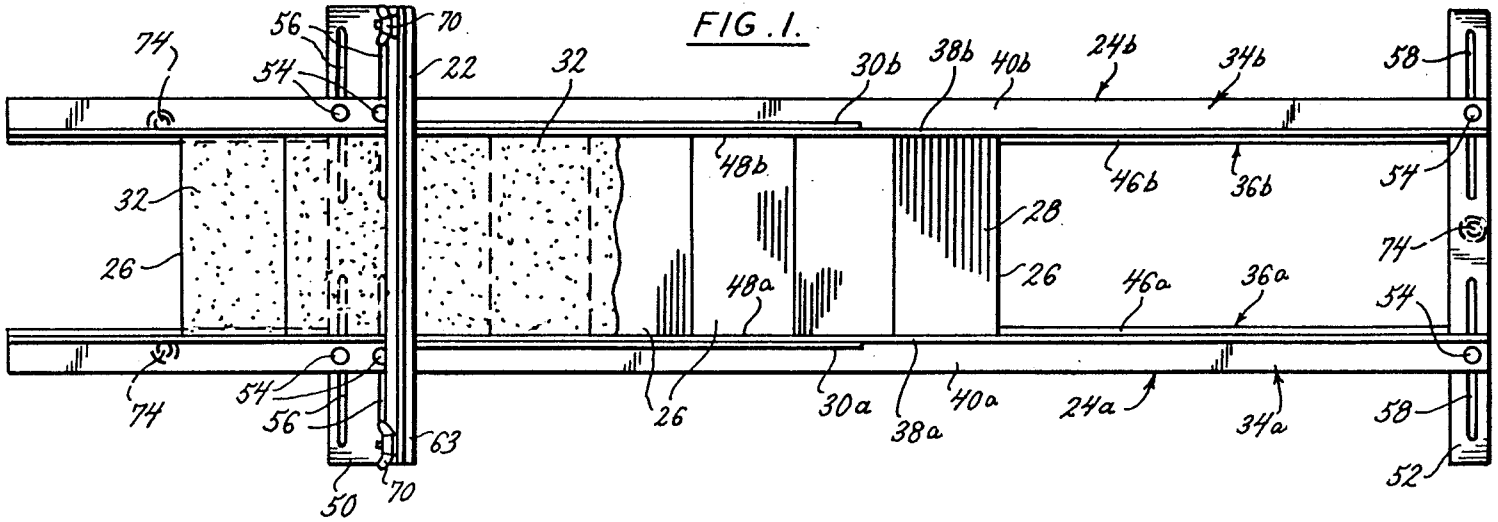
FIG. 1 is a plan of an apparatus of the present invention.
Figure 2:
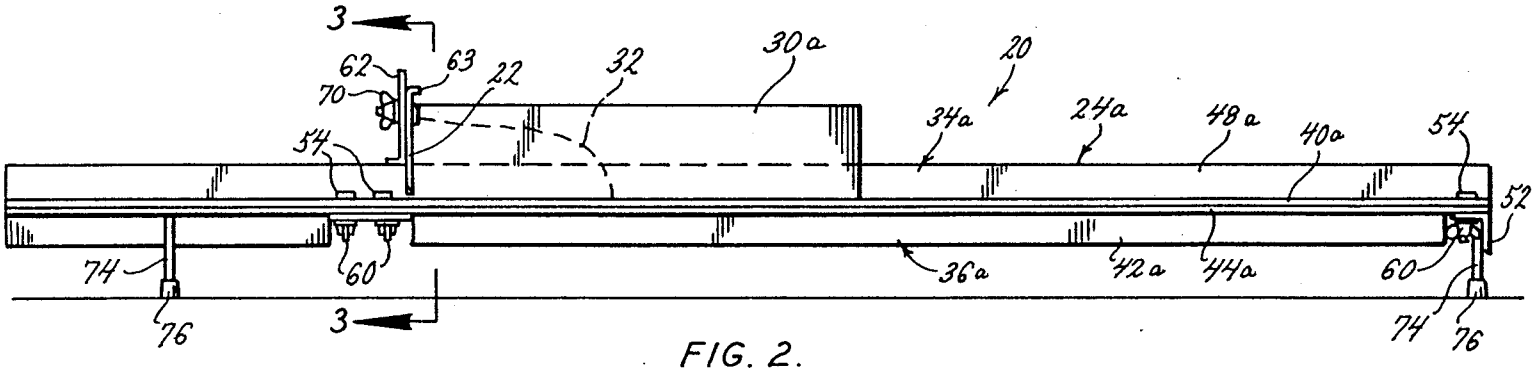
FIG. 2 is a side elevation.

An apparatus, for coating back surfaces of building tiles with mortar, constructed according to the principles of this invention is indicated generally as 20 in FIGS. 1 and 2. It comprises a doctor blade 22 and a pair of parallel rails **24*a* and 24*b* adapted to be spaced apart a distance substantially equal to the width of building tiles 26 for supporting and guiding the tiles 26 for sliding movement thereon below blade 22 with the back surfaces 28 of tiles 26 facing generally upwardly. Longitudinal side plates 30*a* and 30*b* are secured to rails 24*a* and 24*b*, respectively, adjacent blade 22. Side plates 30*a* and 30*b* constitute means for receiving and retaining a supply of mortar 32 on the back surfaces 28 of tiles 26 adjacent one side of blade 22. The lower edge of blade 22 is positioned a preselected distance above back surfaces 28. As tiles 26 are urged under blade 22, back surfaces 28 thereof are completely coated with mortar 32 and the excess is scraped from tiles 26 with the mortar remaining on surfaces 28** being of a substantially uniform thickness.

Figure 3:
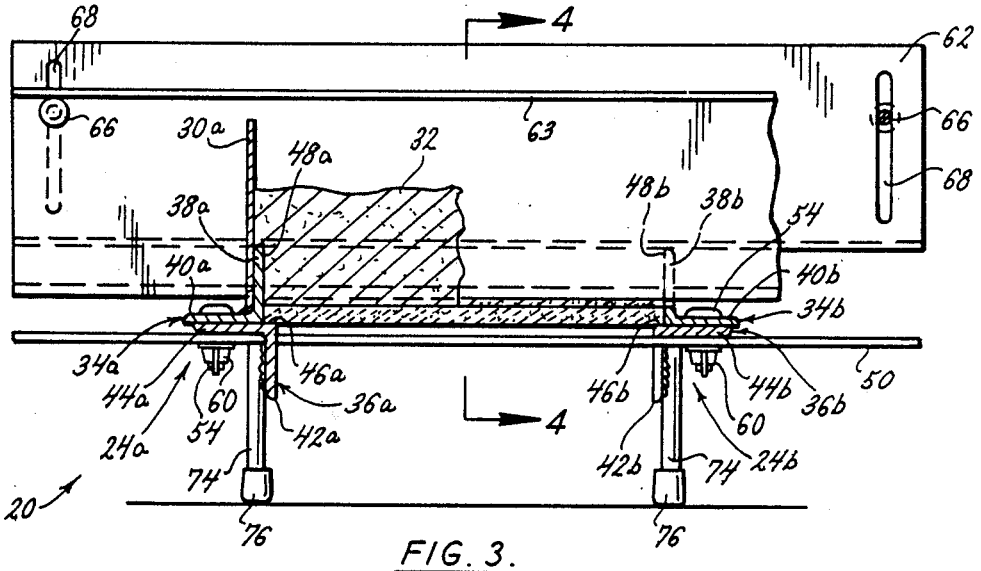
FIG. 3 is a cross-sectional view taken along line 3—3 of FIG. 2 showing the doctor blade.

As shown in FIG. 3, rails **24*a* and 24*b* are each formed from two beams having L-shaped cross sections. Rail 24*a* comprises an upper beam 34*a* and a lower beam 36*a* in face-to-face relation. Likewise, rail 24*b* comprises an upper beam 34*b* and a lower beam 36*b* in face-to-face relation. The upper beams 34*a* and 34*b* have vertical legs 38*a* and 38*b*, respectively, extending generally upwardly and horizontal legs 40*a* and 40*b*, respectively, extending generally outwardly. The lower beams 36*a* and 36*b* have vertical legs 42*a* and 42*b*, respectively, extending generally downwardly and horizontal legs 44*a* and 44*b*, respectively, extending generally outwardly. Horizontal legs 40*a* and 40*b* are in face-to-face relation with horizontal legs 44*a* and 44*b*, respectively. Lower beams 36*a* and 36*b* are offset inwardly of upper beams 34*a* and 34*b* to expose upwardly facing surfaces (or ledges) 46*a* and 46*b* which support the side margins of the under surfaces of tiles for sliding movement thereon. Inwardly facing opposing side surfaces 48*a* and 48*b* prevent transverse motion of the tiles with respect to rails 24*a* and 24*b*** and also prevent mortar placed on the tiles from flowing or dripping down the side edges of the tiles.

To accommodate tiles of various widths, the distance between rails **24*a* and 24*b* is variable. Rails 24*a* and 24*b* are adjustably connected by first and second slotted bars 50 and 52, respectively. Portions of the vertical legs 42a and 42b of lower beams 36a and 36b are cut away so that the bars 50 and 52 can contact the horizontal legs 44a and 44b of beams 36a and 36b. Bolts 54 extend downwardly through holes in rails 24a and 24b and engage slots 56 and 58 in bars 50 and 52, respectively. Wing nuts 60 mate with the bolts 54 for adjustably locking rails 24a and 24b to bars 50 and 52. Thus, rails 24a and 24b** can be moved toward or away from each other and then locked in position to accommodate narrower or wider tiles.

The doctor blade, 22 is vertically adjustable with respect to rails 24a and 24b to accommodate tiles of various thicknesses and to vary the amount of mortar coating the tiles. Doctor blade 22 is attached to the top edges of rails 24a and 24b by a blade support 62 which has a lower flange 64 secured by welding at one side to the top edge of one of the rails. Bolts 66 extend through holes in blade 22 and engage with vertical slots 68 in support 62. Wing nuts 70 mate with bolts 66 for adjustably locking blade 22 to support 62. Blade 22 extends downwardly through slots 72 in vertical legs 38a and 38b of upper beams 34a and 34b. The slots 72 prevent blade 22 from moving longitudinally with respect to rails 24a and 24b. Support 62 maintains blade 22 in vertical relation with respect to rails 24a and 24b. Preferably, support 62 is fixedly secured (e.g., welded) to the top edge of only one of the rails so that transverse adjustment of the distance between the rails is not impeded by support 62. A generally horizontal flange 63 extends from the top margin of blade 22 to act as a handgrip for enabling a user to grip blade 22 for heightwise adjustability. Thus, blade 22 is vertically adjustable with respect to rails 24a and 24b.

A plurality of feet 74 extend downwardly from rails 24a and 24b and bar 52 to elevate the apparatus 20. Rubber tips 76 on the ends of feet 74 prevent scratching of the surface on which the apparatus is placed.

Figure 4:
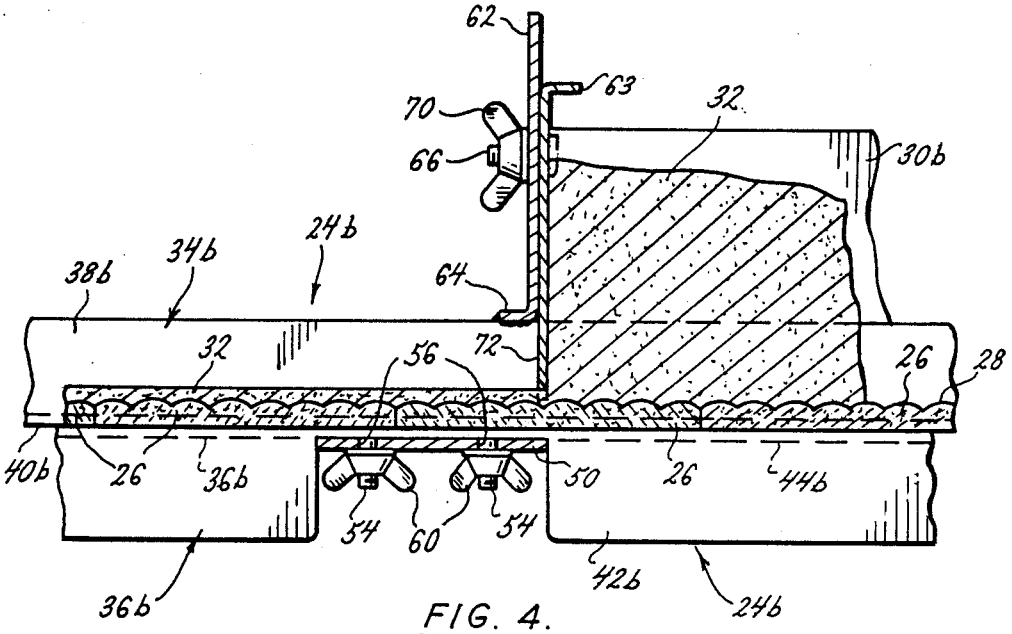
FIG. 4 is a cross-sectional view taken along line 4—4 of FIG. 3 showing the doctor blade.

In operation, rails 24a and 24b are spaced a distance substantially equal to the width of tiles to be coated with mortar. As shown in FIGS. 1, 2, and 4, tiles 26 are placed side-bY-side on rails 24a and 24b with the first tile being adjacent to blade 22. Blade 22 is vertically adjusted so that its lower edge is spaced a preselected distance above the upwardly facing surfaces 28 of tiles 26. Mortar 32 is then poured on tiles 26 adjacent blade 22. The side plates 30a and 30b permit a relatively large amount of mortar to be placed on the tiles adjacent blade 22 without the mortar running over the edges of rails 24a and 24b. The tiles 26 are urged (from right to left as shown in FIGS. 1, 2, and 4) under the lower edge of blade 22 which scrapes excess mortar 32 from the upwardly facing surfaces 28 of tiles 26. Surfaces 28 are completely and uniformly coated with mortar 32. Excess mortar scraped from a tile is rolled over onto the next adjacent tile being urged under blade 22. Thus, a plurality of side-by-side tiles 26 urged from right to left under blade 22 are evenly and completely coated with mortar. The adjustability of the rails permits a user to coat tiles of various sizes with mortar. The vertical adjustability of blade 22 permits a user to coat tiles of various thicknesses and also permits a user to place various thickness of mortar on the tiles. Thus, apparatus 20 is adapted for quickly coating tile with mortar, is easy to operate, has a minimum of parts, is of relatively simple and inexpensive construction, and is compact and lightweight for ease of transportation.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for evenly coating back surfaces of building components, such as building tiles, with mortar comprising a doctor blade, a pair of spaced parallel rails adapted to support and guide building components for movement below the doctor blade with said back surfaces of the building components facing generally upwardly, means for varying the distance between the rails to accommodate building components of various widths, said rails adapted to be spaced a distance substantially equal to the width of the building components, and means defining a region for receiving and retaining a supply of mortar adjacent one side of the blade and for application and distribution of the mortar over the entire width of the back surfaces of the building components for the various widths of building components which the rails are adapted to accommodate, said rails each having an upwardly facing surface adapted to support side edge margins of the building components for sliding movement thereon and a side surface to restrict transverse motion of the building components with respect to the rails, the blade being positioned a preselected distance above said back surfaces of the building components whereby as the building components are urged under the blade said back surfaces thereof are completely coated with mortar and excess mortar is scraped from the building components with the mortar remaining on said back surfaces being of a substantially uniform thickness.

2. Apparatus according to claim 1 further comprising means for varying the spacing between the lower edge of the doctor blade and said back surfaces of the tiles to accommodate tiles of various thicknesses.

3. Apparatus according to claim 1 wherein the means defining a region for receiving and retaining a supply of mortar adjacent one side of the blade comprises longitudinal side plates secured to each rail and adjacent one side of the blade, each side plate extending upwardly with respect to the rails for retaining mortar on said back surfaces and preventing mortar from spilling over the tops of the rails.

* * * * *